United States Patent [19]

Conner

[11] Patent Number: 4,555,999

[45] Date of Patent: Dec. 3, 1985

[54] WAISTBAND INDEXING METHOD AND APPARATUS

[76] Inventor: William R. Conner, P.O. Box 288, Shelbyville, Tenn. 37160

[21] Appl. No.: 597,920

[22] Filed: Apr. 9, 1984

[51] Int. Cl.[4] ..... D05B 19/00; D05B 97/00; D05B 3/12

[52] U.S. Cl. ..... 112/121.27; 112/121.11; 112/262.2; 112/262.3; 112/104

[58] Field of Search ..... 112/121.27, 121.26, 112/121.11, 121.15, 262.2, 262.3, 264.1, 104, 113, 153, 141, 322, 272, 152, 265.1

[56] References Cited

U.S. PATENT DOCUMENTS

| | | | |
|---|---|---|---|
| 3,562,817 | 2/1971 | Huddleston | 2/236 |
| 3,701,165 | 10/1972 | Huddleston | 112/262.3 X |
| 3,867,889 | 2/1975 | Conner, Jr. | 112/121.11 |
| 4,287,842 | 9/1981 | Breck, Jr. | 112/121.27 |
| 4,389,957 | 6/1983 | Block et al. | 112/262.3 |
| 4,393,800 | 7/1983 | Hargett | 112/265.1 |
| 4,467,734 | 8/1984 | Rohr | 112/63 |
| 4,502,399 | 3/1985 | Seaman | 112/121.27 |

OTHER PUBLICATIONS

The Tice Automatic Style Looper.

"Introducing the Doubly-Fast AMF Twin Needle Automatic Belt Loop . . . ", Mar. 1983, Bobbin, p. 81.

"Nobody Does it Better or Cheaper".

*Primary Examiner*—Peter Nerbun

*Attorney, Agent, or Firm*—Thomas & Kennedy

[57] ABSTRACT

During the manufacture of trousers a waistband is indexed to a sewing station for the sewing of belt loops thereto by the method of placing the waistband and trousers' crotch seam at the stitching station, moving the waistband lengthwise until a waistband end is detected by a detector located at a predetermined distance from the stitching station while measuring the distance of waistband travel to determine both the length of a waistband and its location with respect to the stitching station, and incrementally positioning the waistband at the stitching station at a plurality of waistband positions preselected for its determined length. Apparatus for performing the method include a waistband drive mechanism, a position sensor, and a microprocessor.

13 Claims, 8 Drawing Figures

WAISTBAND INDEXING METHOD AND APPARATUS

TECHNICAL FIELD

This invention relates to a waistband indexing apparatus, particularly to a method and apparatus for automatically indexing trouser waistbands and for sewing belt loops to the waistband of trousers at a sewing station.

BACKGROUND OF THE INVENTION

Casual pants, such as dungarees and jeans, ordinarily have a waistband to which belt loops are sewn at intervals. In the manufacture of such trousers individual belt loops have been taken by a sewing machine operator, folded at opposite ends, and each end then sewn to the waistband. Such manual handling of individual belt loops has been a time consuming and costly process.

Recently, machines have been developed for automatically folding and positioning belt loops onto trouser waistbands preparatory to the belt loops being attached thereto by the use of a sewing machine. Examples of these machines are disclosed in U.S. Pat. Nos. 4,389,957, 4,393,800 and 4,287,842.

Though the just described machines have provided advancements in the art of automating trouser waistband manufacture, they have not eliminated the need for locating the positions along the waistband at which the various belt loops are to be attached. As described by U.S. Pat. No. 3,562,817, a system was developed in which waistbands were marked at the positions where the loops are to be attached, which marks were later sensed by sensors of the machinery used in placing the belt loops on the waistbands. However, this requires the separate steps of marking, detecting the marks and placing the loops on the waistband.

Waistbands are made in many different sizes for men's, women's, and children's trousers. The number of belt loops varies according to the size of the trousers and to the style of the trousers. In some cases the belt loops are equally spaced from one another along the length of the waistband while in other cases they are not. This wide variety in both the number and arrangement of the belt loops on the waistband presents a problem to the trouser manufacturer since such variety handicaps efficient manufacture.

SUMMARY OF THE IVNENTION

Briefly described, the present invention comprises a waistband indexing apparatus and a method of sewing belt loops to the waistband of trousers. The method includes the steps of placing the waistband with its near crotch seam centered at the sewing station, sewing a first belt loop to the waistband in alignment with the crotch seam, and moving the waistband lengthwise across the sewing station until a waistband end is detected by a detector located at a predetermined distance from the sewing station while measuring the distance of waistband travel to determine both the length of the waistband and the position of the end of the waistband with respect to the sewing station. The movement of the waistband is terminated, and the second belt loop is then sewn to the waistband. The waistband is then incrementally positioned at the sewing station at a plurality of waistband positions selected for its determined length and a belt loop is attached at each position.

A drive means is provided for reversibly driving a waistband through the sewing station and means for sensing an end of the waistband as it is driven by the drive means from the centered position with respect to the sewing station. Means are provided for measuring the distance of waistband travel when the waistband is driven by the drive means from the centered position and for deriving therefrom the length of the waistband. Means are also provided for determining a series of linearly spaced belt loop positions along the waistband based on the derived waistband length, and drive control means are provided for incrementally causing said drive means to drive the waistband along its length through the sewing station to each position in the series of linearly spaced belt loop positions.

In the embodiment disclosed, the drive means of the apparatus includes a stepping motor for reversibly driving a waistband through the sewing station. The means for measuring the length of the waistband and stopping the movement of the waistband at each belt loop position comprises a microprocessor coupled with the stepping motor so as to cause the stepping motor to drive the waistband successively to positions in the series of determined linearly spaced positions.

A pair of lower drive rollers stradde the sewing station, a pair of upper idler rollers also stradde the sewing station and are biased toward engagement with the drive rollers, and the stepper motor rotates the drive rollers in common rotary directions.

Thus, it is an object of this invention to provide a method and the apparatus for automatically moving the waistband of trousers through a sewing station and stopping the movement of the waistband at positions where a belt loop is placed on and sewn to the waistband.

Another object of this invention is to provide a method and apparatus for automatically sewing belt loops to the waistband of trousers, in which the waistband is placed in a sewing machine with the rear of the waistband centered at the sewing needle position, and the waistband is automatically moved until one of its ends approaches the sewing needle, whereupon the movement of the waistband is reversed until the other end of the waistband approaches the sewing needle, and the movement of the waistband is interrupted and belt loops sewn thereto at positions along the length of the waistband.

Another object of this invention is to provide a system for automatically measuring the length of the waistband of trousers and sewing belt loops to the waistband at locations spaced apart in proportion to the length of the waistband.

Other objects, features and advantages of the invention will become apparent upon reading the following specification, when taken in conjunction with the accompanying drawing.

DETAILED DESCRIPTION OF THE DRAWING

Figure 3:
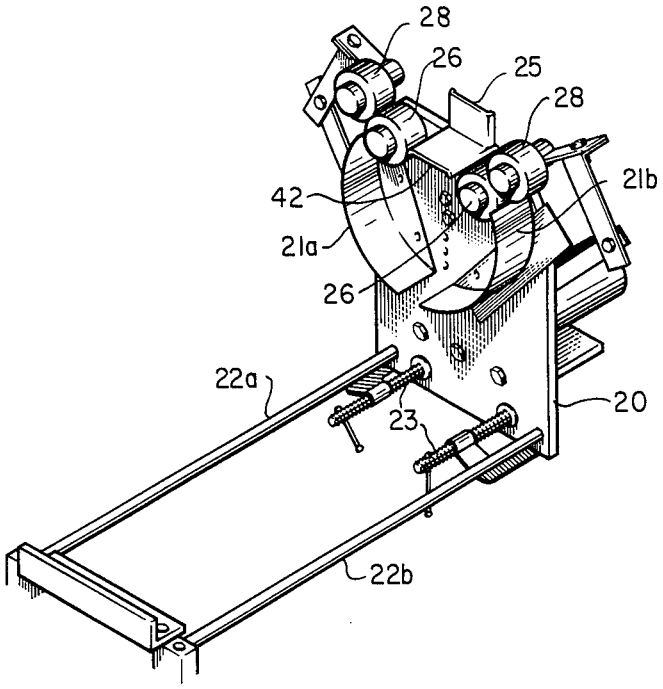
FIG. 3 is a perspective view of the indexing apparatus of FIG. 1 shown detached from a sewing machine and without a pair of jeans or other type of trousers mounted thereto.

Referring now in more detail to the drawing, in which like numerals indicate like parts throughout the several views, FIG. 3 illustrates a trouser waistband indexing apparatus 9 that embodies principles of the present invention and which includes a frame 20 to which a pair of mutually parallel spaced, arcuate guide collars 21*a* and 21*b* is mounted. A pair of support rods 22*a* and 22*b* projects outwardly from the frame 20 straddling a pair of mounting bolts 23. An L-shaped waistband guide 25 is mounted to the frame 20 above and between the upper ends of the guide collars 21. A pair of lower drive rollers 26 is rotatably mounted between the L-shaped guide 25 and the two guide collars 21. A pair of upper guide rollers 28 is mounted for movement toward rotary contact with the lower guide rollers 26. A photoelectric sensor 42 is mounted between one of the rollers 26 and the L-shaped guide 25.

Figure 5:
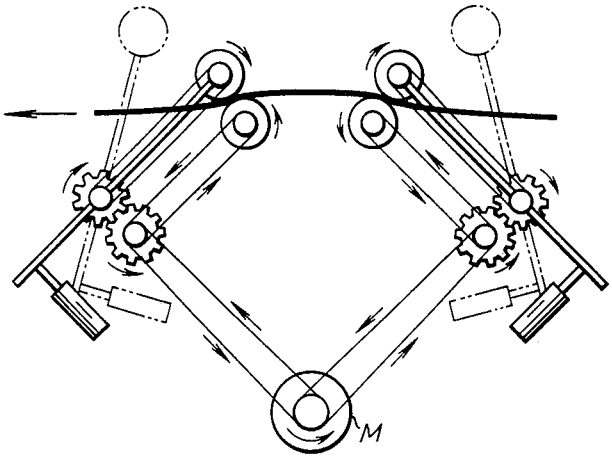
FIG. 5 is a diagrammatical view of the power train of the indexing apparatus.

A power drive system is provided for the rollers as illustrated schematically in FIG. 5 which, for clarity, has not been shown in FIG. 3. The power drive system includes a stepping motor M which, for example, may be a Sigma Model No. 20-42661S-22770-E. The drive systems on opposite sides of the motor M are identical and each drive system includes an endless drive belt 30 routed about sheaves mounted on the motor output drive shaft and about one of a pair of sheaves 31 mounted to the axle of a spur gear 32. Endless belt 34 is routed over the other of the pair of sheaves 31 and about sheave 35 to which the lower drive roller 26 is rigidly mounted. Anotheer spur gear 36 engages gear 32 and a sheave 33 rotates in unison with gear 36. Support arm 38 is mounted to and pivotable about the axle of sheave 33 and gear 36. Belt 39 is routed over the sheave 33 and the sheave 37 attached to idler roller 28. An air cylinder 40 is coupled with the end of the arm 38 distal the upper idler roller 28 for moving the upper idler rollers between positions in rotary contact with the lower drive roller, as shown in solid lines in FIG. 5, and a position out of rotary contact with the lower drive roller as shown in broken lines. In operation the drive roller and idler rollers do not actually engage each other when jeans 10 are driven therebetween. So constructed, the power train moves the waistband of a pair of jeans 10 in the direction of arrow 41 when the stepper motor is rotating in a counterclockwise direction as indicated by arrow 42 in FIG. 5, and the belts are thereby driven in the direction of the arrows shown over them. Conversely, when the direction of rotary movement of the output shaft of the stepper motor is reversed the jeans are driven the direction opposite to that of arrow 41.

Figure 1:
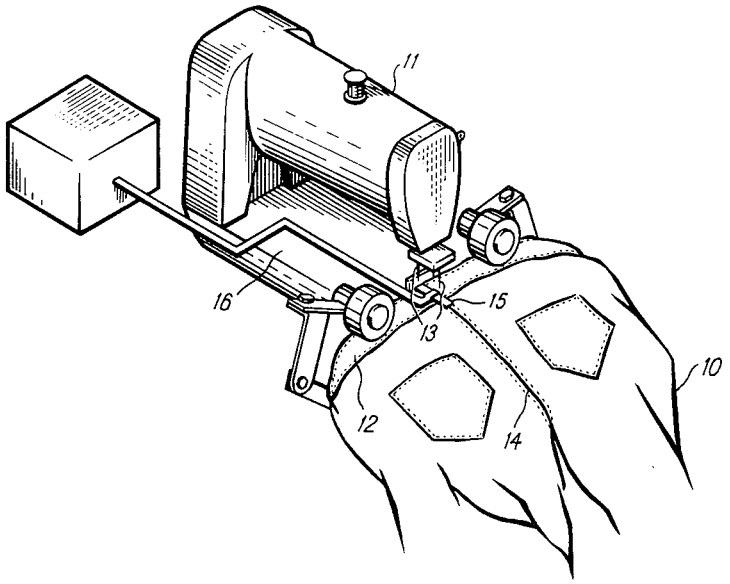
FIG. 1 is a perspective view of the waistband indexing apparatus shown operatively mounted at a sewing machine, with the waistband of trousers positioned at the sewing station of the sewing machine.
Figure 2:
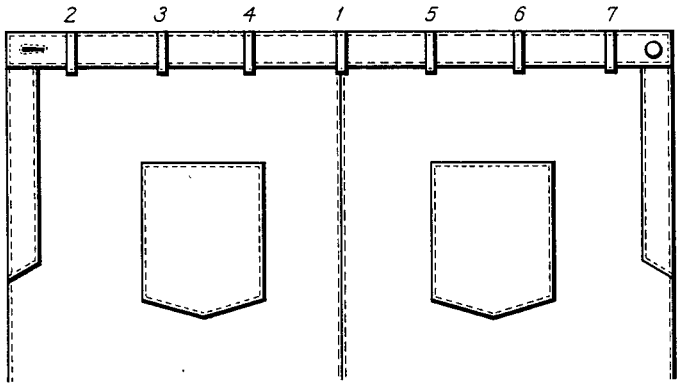
FIG. 2 illustrates the upper portion of a pair of jeans having a waistband to which a set of belt loops are sewn.

As illustrated in FIG. 1, the indexing apparatus 9 just described is shown mounted on a sewing machine 11 for operation in indexing the waistband 12 of a pair of trousers or jeans 10 through a series of positions for stitching belt loops thereto over a sewing machine stand or pedestral 16. A belt looper of conventional design is also positioned here for cutting, forming and positioning belt loops, such as loop 15 shown in FIG. 1, onto the waistband 12. The belt looper is shown only schematically at 45 holding the belt loop 15 in position. A detailed illustration of a conventional belt looper has not been illustrated, but automatic belt loop machines such as the Drop Loop Setter by Tice Engineering & Sales, Inc. of Knoxville, Tenn. or the Twin Needle ABL by AMF can be used.

In FIG. 1 the loop 15 is shown to have been placed and held by the looper 45 to the waistband 12 along the bilaterial crotch seam 14 of the jeans. In operation the indexing apparatus intermittently moves the waistband left and right, as viewed in FIG. 1, to locate the waistband at several positions at the sewing station beneath the needles 13 of the sewing machine. Each time the waistband is relocated the looper 45 positions another belt loop at the sewing station and holds it in place as the loop is stitched to the waistband by the sewing machine 11.

Figure 4:
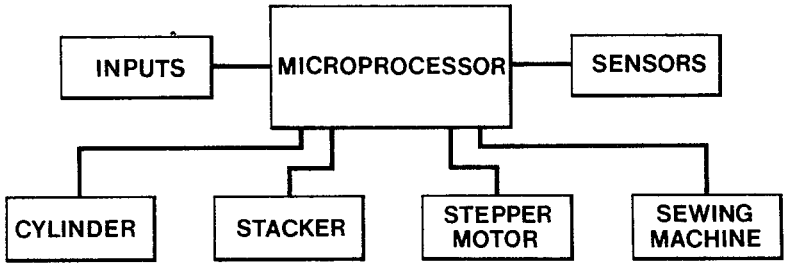
FIG. 4 is a block diagram of control means of the indexing apparatus illustrated in FIG. 3.

FIG. 4 schematically illustrates the control system of the apparatus. The system includes a microprocessor which may be a Motorola type 6821 coupled with a type 6809. The microprocessor is inputted with a start switch, a selector switch for setting the number of loops to be stitched to the waistband, and selector switches for indicating the proportionality of spacing of the loops along the waistband. The photoelectric sensor 42 is also inputted into the microprocessor. Where a single needle type sewing machine is used another sensor may also be inputted to the microprocessor for sensing the position of the lower end of each belt loop at the stitching station. The control system is also seen to have control lines extending from the microprocessor to the air cylinders for opening and closing the drive rollers. Similarly, the sewing machine 11, the looper 45 and the stepping motor M are coupled with the microprocessor.

Figure 6:
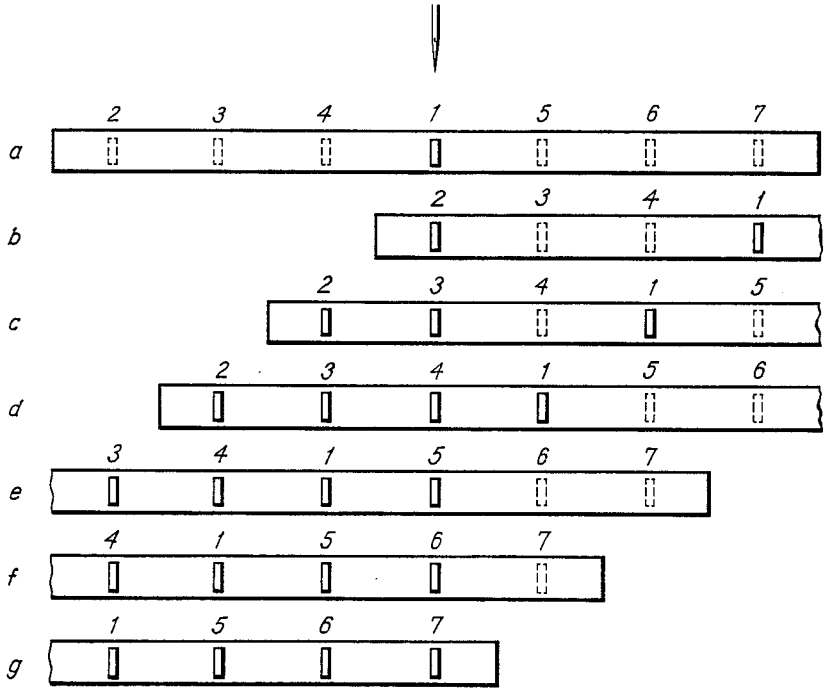
FIG. 6 is a flow diagram illustrating a sequence of waistband positions as the belt loops are sewn to the waistband.

A sequence of operation may be best appreciated by reference next to FIG. 6 which shows a sequence of waistband positions a–g with respect to the stitching station, i.e. sewing machine needles 13, for stitching seven belt loops to a waistband in accordance with the present invention. Loop positions are here shown in broken lines while actual loops are shown in solid lines.

The jeans are first positioned with the waistband 12 and the bilateral crotch seam 14 located at the stitching station beneath the sewing machine needles 13 atop the sewing machine stand 16 with the upper rollers 28 elevated above the lower rollers 26. The automated sequence of the indexing is then commenced by manually pushing the start button. The microprocessor actuates the looper 45 whereupon it cuts, forms and positions a belt loop 15 at position 1 on the jeans which is in alignment with the crotch seam 14 as shown in FIG. 1. With the belt loop held by the looper in place the sewing machine is next actuated by the microprocessor causing the loop at position 1, which corresponds to loop 15 in FIG. 1, to be stitched to the waistband by the sewing machine 11 as shown with the waistband at position "a" in FIG. 6. The microprocessor then actuates the cylinder causing the rollers to close the stepping motor M which moves the waistband to the right until sensor 42 detects its end. Movement of the waistband is thereupon halted with the waistband now located at position "b"

in FIG. 6 and the looper and the sewing machine then sequentially actuated to cause a loop to be sewn to the waistband at position 2. Alternatively, it may be desirable to program the apparatus to make some movement of the waistband after the waistband end has been detected, depending on the desired position of the loop at position 2 relative to the end of the waistband in comparison with the spacing of the sensor 42 from the needles 13 at the stitching station, and the particular set of preselected proportional spacings.

As the stepping motor initially moves the waistband from position "a" to position "b" as shown in FIG. 6, each step of the motor is counted by the microprocessor. Upon sensing the end of the waistband the microprocessor computes the waistband length. This is possible since the middle of the waistband at the crotch seam was the starting point, since the length of linear waistband movement atop the stand 16 for each step of motor M is known as is the distance between the sensor and the stitching station, and since the waistband movement is linear even though the trousers are not actually flat. The microprocessor then computes from a preselected set of proportionality spacings the actual spacing and location for each loop. In FIG. 6 each of the positions are shown spaced equally apart. It should however be understood that, depending on the style of the trousers or jeans, such positions may not necessarily be equal. Thus, for some styles the end loops may be located closer together, for example, than more centrally located loops.

After the loop has been sewn to the waistband at position 2 the apparatus next indexes the waistband to locate position 3 at the sewing station. After a loop has been sewn to the waistband at position 3 the apparatus indexes the waistband to locate position 4 at the sewing station as shown at position "d". Following this loops are sequentially stitched to the waistband at positions 5, 6 and 7 as sequentually shown at positions "e", "f", and "g". Upon the stitching of the last loop the stepper motor steps the waistband completely out of the stitching station for stacking.

For another example, where the distance or spacing betwen loop positions 2 and 3 and between loop positions 4 and 1 are each to be 30% of the distance between positions 1 and 2, and the distance between positions 3 and 4 is therefore to be 40%, and where the distance between positions 1 and 4 is measured as 640 steps of the stepper motor, the indexing distances are calculated by the microprocessor as follows:

Distance 2–3 is 30% of 640 or 192 steps
Distance 3–4 is 40% of 640 or 256 steps
Distance 4–1 is 30% of 640 or 192 steps Assuming bilateral symmetry, distances 1–5 and 6–7 would also be 192 steps while the distance 5–6 would be 256 steps.

Figure 7A:
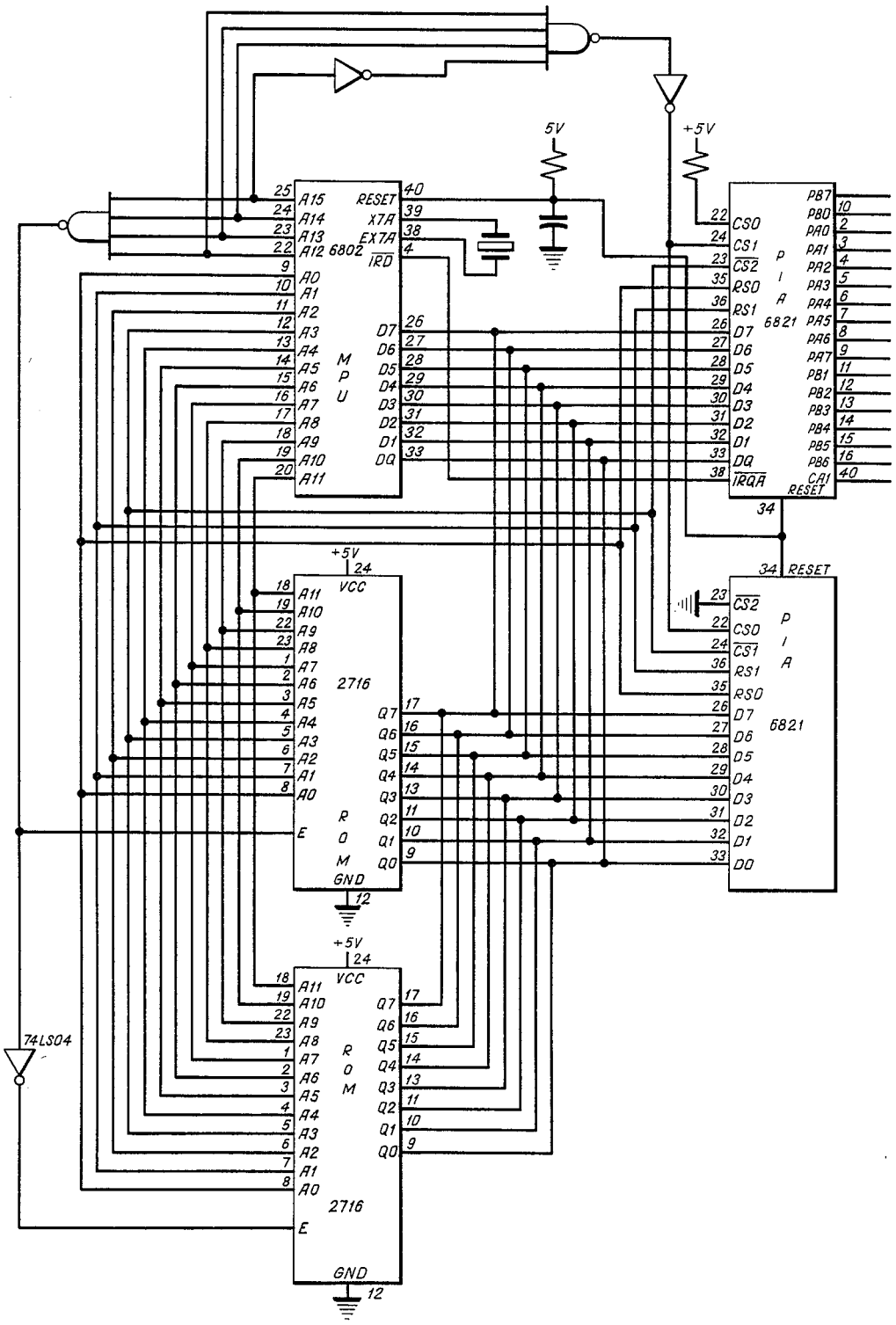
FIG. 7, which appears on two fit-to-match sheets as FIGS. 7*a* and 7*b*, is a circuit diagram of alternative control means for the indexing apparatus illustrated in FIG. 3.

FIG. 7 provides a detailed illustration of another control system that may be used in operating the indexing apparatus as previously described. The control system here is seen to include a 6802 MPU, preferably a Motorola type MC 6802 microprocessor, to which two 2716 ROMs, preferably Intel 2716 erasable, programmable read only memories, are coupled. The E pin of one ROM is connected through a 74LS04 inverter to the E pin of the other ROM while both are connected to the MPU through a 74LS04 type 4 input NAND gate. A 4 MHz crystal is connected across pins 38 and 39 of the MPU to provide a clock function while an RC time delay is provided to pin 40. The microprocessor and ROMs are connected to two parallel interface adapters, specifically to two 6821 type PIAs. Connection to the PIAs from MPU pins 22–25 is made through address decoding circuiting that includes two other 74LS04 inverters and a 4-input NAND. The routine, i.e. the loop style including numbers of loops and spacing proportionality, is selected by means of a 2 digit binary coded decimal (BCD) thumb wheel switch.

Figure 7B:
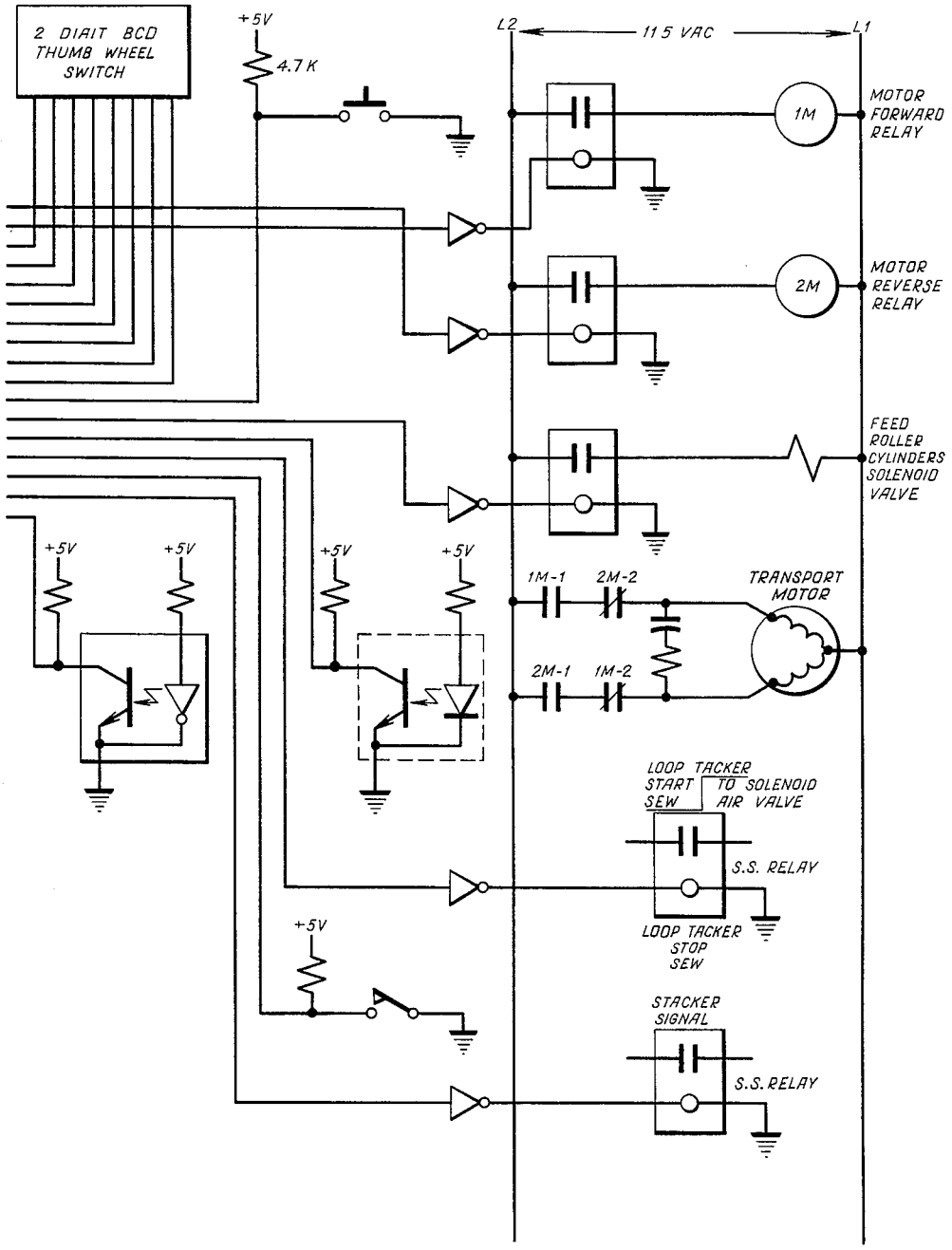

Sensors and controlled units coupled with the computer are shown on FIG. 7*b*. These include a start switch coupled with pin 11 of the PIA and to +5 VDC through a 4.7K pull-up resistor. An optical coupler is coupled with pin 40 of the PIA which coupler is mounted on a drive roller shaft for counting roller rotations in measuring waistband travel. Another optical coupler, which senses the end of the waistband is connected to pin 13 of the PIA. A limit switch is connected to +5 VDC through a 4.7K pull-up resister and to pin 15 of the PIA which switch is actuated each time a sewing cycle has been completed by the sewing machine in sewing one loop into place. A solid state relay is coupled to PIA pin 16 through an inverter and to an unshown 115 VAC source and to an unshown stacker solenoid. Similarly, another solid state relay is coupled with pin 14 through an inverter and to a 115 VAC source and solenoid for actuating the sewing head and loop positioner.

The control circuitry is further seen to have two bus bars L1 and L2 placed across 115 VAC. The transport motor is connected across L1 and L2 through motor starter relays 1M-1, 1M-2, 2M-1 and 2M-2 with an RC filter also provided to damper voltage spikes. Three relays are respectively coupled to the PIA through investers for affecting motor forward, motor reverse and the feed roller cylinder solenoids.

It thus is seen that a method and apparatus has been devised for automatically indexing a waistband that provides a distinct advance in the art. It should be understood that the just described embodiments merely illustrate principles of the invention in preferred forms. Many modifications, additions and deletions may, of course, be made thereto without departure from the spirit and scope of the invention as set forth in the following claims.

I claim:

1. A method of indexing the waistband of trousers of the type having a bilateral crotch seam for sewing thereto a set of belt loops at a stitching station comprising the steps:

(a) placing the waistband and seam at the stitching station;

(b) moving the waistband lengthwise until a waistband end is detected by a detector located at a predetermined distance from the stitching station while measuring the distance of waistband travel to determine both the length of a waistband and its location with respect to the stitching station; and (c) incrementally positioning the waistband at the stitching station at a plurality of waistband positions preselected for its determined length.

2. The waistband indexing method of claim 1 where in step (c) the waistband is incrementally positioned at the stitching station at a series of waistband positions having spacial bilateral symmetry with respect to the seam.

3. The waistband indexing method of claim 2 where in step (c) the series of positions includes one located along the seam.

4. Apparatus for indexing the waistband of trousers for sewing thereto at a stitching station belt loops at a series of waistband positions comprising, in combination, drive means for reversibly driving a waistband through the stitching station, means for sensing an end of the waistband as it is driven by said drive means from a preselected position with respect to the stitching station, means for measuring the distance of waistband travel when driven by said drive means and for deriving therefrom the length of the waistband, means for determining a series of linearly spaced positions along the waistband from a preselected series of proportionally spaced locations and the derived waistband length, and drive control means for incrementally causing said drive means to drive the waistband to the positions in said series of linearly spaced determined positions.

5. The indexing apparatus of claim 4 wherein said drive means includes a pair of mutually spaced drive rollers straddling the stitching station, a stepper motor, and means for transmitting power from said stepper motor to said pair of drive rollers.

6. The indexing of claim 5 wherein said drive means further includes a second pair of rollers straddling the stitching station and means for moving said second pair of rollers between a position spaced from said pair of drive rollers and a position in rotary contact with said drive rollers.

7. The indexing apparatus of claim 6 wherein said drive means further includes means for transmitting power from said stepper motor to said second pair of rollers.

8. The indexing apparatus of claim 6 wherein said drive means includes a stepper motor and wherein said measuring means includes a microprocessor coupled with said stepper motor and said sensing means.

9. Apparatus for indexing the waistband of trousers to a series of positions for sewing thereto at a stitching station a set of belt loops comprising, in combination, drive means including a stepper motor for reversibly driving a waistband through the stitching station; sensor means for sensing an end of the waistband driven by said drive means; and microprocessor means coupled with said drive means, stepper motor and said sensor means for measuring the distance of waistband travel when driven by said drive means from a preselected position with respect to said sensor means to said sensor means, for determining a series of linearly spaced positions along the waistband from a preselected series of proportionally spaced locations and from the waistband length derived from the measured distance of waistband travel, and for controlling said stepper motor so as to cause it to drive the waistband successively to the positions in the series of determined linearly spaced positions.

10. Apparatus for indexing the waistband of trousers into positions for sewing belt loops thereto comprising, in combination, a pair of lower drive rollers straddling a stitching station, a pair of upper drive rollers straddling the stitching station; means for reversibly driving at least one of said pairs of drive rollers in common rotary directions; means for sensing an end of a waistband as it is driven by said rollers through the stitching station, and computation and control means for determining the length of the waistband by measuring the movement of one end portion thereof to said sensor means and for incrementally actuating said drive means according to a program selected for the determined waistband length.

11. The apparatus for indexing of claim 10 and further comprising means for moving said upper drive rollers from positions elevated above said lower drive rollers and positions biased toward rotary contact with said lower drive rollers.

12. The indexing apparatus of claim 10 wherein said computation and control means comprises a microprocessor.

13. Apparatus for moving the waistband of trousers through the needle position of a sewing machine comprising a pair of arcuate guides for mounting on opposite sides of the needle position of the sewing machine and forming a convex guide path across the throat of the sewing machine, the convex guide path of said arcuate guides being sized and shaped to be encircled by the waistband of trousers, drive means for engaging the waistband and moving the waistband about the convex guide path, and control means for interrupting the movement of the waistband as the waistband moves about the convex guide path while a belt loop is sewn to the waistband.

* * * * *